US011353225B2

(12) United States Patent
Geadelmann et al.

(10) Patent No.: US 11,353,225 B2
(45) Date of Patent: Jun. 7, 2022

(54) FAN COIL THERMOSTAT WITH AUTOMATIC FAN RESET

(71) Applicant: Honeywell International Inc., Morris Plains, NJ (US)

(72) Inventors: Levi H. Geadelmann, Edina, MN (US); Daniel J. Sullivan, St. Anthony, MN (US); Camel Zhang, Tianjin (CN); Gary Yang, Tianjin (CN); Angela Zhao, Tianjin (CN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 598 days.

(21) Appl. No.: 15/368,472

(22) Filed: Dec. 2, 2016

(65) Prior Publication Data

US 2017/0082311 A1 Mar. 23, 2017

Related U.S. Application Data

(63) Continuation of application No. 11/833,685, filed on Aug. 3, 2007, now abandoned.

(51) Int. Cl.

| | |
|---|---|
| ***F24F 11/30*** | (2018.01) |
| ***F24F 11/77*** | (2018.01) |
| *F24F 11/61* | (2018.01) |
| *F24F 110/10* | (2018.01) |

(52) U.S. Cl.

CPC ..... *F24F 11/30* (2018.01); *F24F 11/77* (2018.01); *F24F 11/61* (2018.01); *F24F 2110/10* (2018.01)

(58) Field of Classification Search

CPC .. F24F 11/30; F24F 11/77; F24F 11/61; F24F 11/74; F24F 1/0007; F24F 2110/10; F24F 2120/20

See application file for complete search history.

(56) References Cited

U.S. PATENT DOCUMENTS

| | | | |
|---|---|---|---|
| 3,653,589 | A | 4/1972 | McGrath |
| 3,653,590 | A | 4/1972 | Elsea |
| 3,674,203 | A | 7/1972 | McGrath |
| 3,684,170 | A | 8/1972 | Roof |
| 3,945,432 | A | 3/1976 | Tamblyn |
| 4,049,044 | A | 9/1977 | Cohen |
| 4,333,316 | A | 6/1982 | Stamp, Jr. et al. |
| 4,403,646 | A | 9/1983 | Fodera |
| 4,531,454 | A | 7/1985 | Spoormaker |
| 4,639,709 | A | 1/1987 | Koets |
| 4,675,828 | A | 6/1987 | Winston |
| 4,754,607 | A | 7/1988 | Mackay |
| 4,824,013 | A | 4/1989 | Gouldey |

(Continued)

OTHER PUBLICATIONS

City of Berkeley CECO (Commercial Energy Conservation Ordinance), 12 pages, prior to Aug. 3, 2007.

(Continued)

*Primary Examiner* — Travis Ruby

(74) *Attorney, Agent, or Firm* — Seager, Tufte & Wickhem, LLP

(57) ABSTRACT

A fan coil thermostat includes a controller that implements a control algorithm that includes an Auto fan speed mode. The controller is programmed to permit a user to manually select a fan speed setting using the user interface. In response, the controller initiates a timer, and automatically returns to the Auto fan speed mode once the timer expires.

2 Claims, 5 Drawing Sheets

(56) References Cited

U.S. PATENT DOCUMENTS

| | | | |
|---|---|---|---|
| 4,918,615 | A | 4/1990 | Suzuki et al. |
| 5,024,379 | A | 6/1991 | Dempsey |
| 5,101,639 | A | 4/1992 | Wruck et al. |
| 5,123,592 | A | 6/1992 | Desmarais et al. |
| 5,131,236 | A | 7/1992 | Wruck et al. |
| 5,133,193 | A | 7/1992 | Desmarais et al. |
| 5,138,842 | A | 8/1992 | Wruck et al. |
| 5,167,366 | A | 12/1992 | Desmarais et al. |
| 5,170,635 | A | 12/1992 | Wruck et al. |
| 5,172,565 | A | 12/1992 | Wruck et al. |
| 5,173,843 | A | 12/1992 | Rowlette et al. |
| 5,210,477 | A | 5/1993 | Rowlette et al. |
| 5,261,483 | A | 11/1993 | Imaoka |
| 5,305,952 | A | 4/1994 | Hannarong |
| 5,318,224 | A | 6/1994 | Darby et al. |
| 5,397,970 | A | 3/1995 | Rowlette et al. |
| 5,460,221 | A | 10/1995 | Stalsberg et al. |
| 5,476,221 | A | 12/1995 | Seymour |
| 5,492,273 | A | 2/1996 | Shah |
| 5,528,229 | A | 6/1996 | Mehta |
| 5,592,058 | A | 1/1997 | Archer et al. |
| 5,592,989 | A | 1/1997 | Lynn et al. |
| 5,682,949 | A | 11/1997 | Ratcliffe et al. |
| 5,718,372 | A | 2/1998 | Tishler |
| 5,727,395 | A | 3/1998 | Guo et al. |
| 5,737,934 | A | 4/1998 | Shah |
| 5,797,273 | A | 8/1998 | Guo et al. |
| 5,797,717 | A | 8/1998 | Tanaka et al. |
| 6,012,296 | A | 1/2000 | Shah |
| 6,102,749 | A | 8/2000 | Lynn et al. |
| 6,295,823 | B1 | 10/2001 | Odom et al. |
| 6,318,639 | B1 | 11/2001 | Toth |
| 6,478,233 | B1 | 11/2002 | Shah |
| 6,557,771 | B2 | 5/2003 | Shah |
| 6,716,406 | B2 | 4/2004 | Reisfeld et al. |
| 6,736,328 | B1 | 5/2004 | Takusagawa |
| 6,772,049 | B2 | 8/2004 | Choi |
| 7,076,961 | B2 | 7/2006 | Takusagawa |
| 7,106,019 | B2 | 9/2006 | Becerra et al. |
| 7,131,490 | B1 | 11/2006 | Roskewich |
| 7,249,931 | B2 | 7/2007 | Parker et al. |
| 7,308,906 | B2 | 12/2007 | Sinclaire |
| 7,618,233 | B2 | 11/2009 | Parker et al. |
| 2005/0115258 | A1* | 6/2005 | Violand ..... F24F 1/027 62/186 |
| 2007/0084939 | A1 | 4/2007 | Liu |
| 2009/0032236 | A1 | 2/2009 | Geadelmann et al. |

OTHER PUBLICATIONS

Guestat, Digital Thermostat, Installation Instructions, 35 pages, Oct. 2003.

http://www.thisisbroken.com/b/2005/07/chancery_court_.html, "This is Broken—Hotel Thermometer," 8 pages, printed May 24, 2007.

Line Voltage Premier Series, Installation and Operating Instructions, 8 pages, Dec. 13, 2006.

Peco, "T168 Proportional Thermostat, Smart Energy Management," 2 pages, 2008.

Peco, T155 Auto/Manual Changeover Thermostat, 2 pages, 2005.

Peco, T170 Commercial Thermostat, 2 pages, 2005.

Peco, T170 Commercial Thermostat, Continuous or Cycling Fan, 1 page, 2005.

Peco, T170 Hospitality Thermostat, Application Guide, 1 page, Jan. 19, 2006.

Peco, T170 Thermostat, 24 VAC/120-277 VAC on/off Control, 2 pages, 2005.

Peco, T170/S200 Application Guide, 2 pages, prior to Aug. 3, 2007.

Peco, TA155 Thermostat, Manual Changeover, 1 page, 2005.

SST-1 Heating and Cooling with Automatic Changeover, Operating Instructions, 2 pages, prior to Aug. 3, 2007.

XCI Corporation, "Application Note: Hotel/Motel Energy Management," 3 pages, 1997-1998.

* cited by examiner

FAN COIL THERMOSTAT WITH AUTOMATIC FAN RESET

This is a continuation application of co-pending U.S. patent application Ser. No. 11/833,685, filed Aug. 3, 2007, and entitled "FAN COIL THERMOSTAT WITH AUTOMATIC FAN RESET", which is incorporated herein by reference.

TECHNICAL FIELD

The present disclosure pertains generally to thermostats and more particularly to thermostats adapted for use with fan coils.

BACKGROUND

A variety of buildings such as hotels, apartment buildings and the like are heated and cooled using fan coil systems. In a fan coil system, a heat transfer fluid such as water is pumped or otherwise forced through a fan coil. A fan is used to blow air across the fan coil. If the heat transfer fluid was heated, heated air will blow out of the fan coil system. Conversely, if the heat transfer fluid was cooled, cool air will blow out of the fan coil system.

Like other HVAC systems, fan coil systems often consume significant amounts of energy. For many buildings, such as hotels and other structures, a number of rooms may, at any given time, be unoccupied. A significant amount of energy may be saved by not running a fan at a higher than necessary speed, particularly when a room or other space is not occupied.

SUMMARY

The present disclosure pertains to fan coil thermostats that can provide energy savings by, for example, not unnecessarily running a fan longer than necessary and/or at a higher speed than necessary, particularly when a room or other space is not occupied. Fan coil systems employing such a fan coil thermostat may be more energy efficient.

In an illustrative but non-limiting example of the present disclosure, a fan coil thermostat is configured for use with a fan coil system. In some cases, a fan coil system may include a fan coil that is configured for fluid communication with a source of heated fluid and/or a source of cooled fluid, a valve that controls fluid flow through the fan coil and a fan that blows air across the fan coil.

The fan coil thermostat may include a controller that implements a control algorithm that is adapted to at least partially control one or more components of the fan coil system and that may include an Auto fan speed mode. The fan coil thermostat may include a user interface as well as a timer that is controlled by the controller. The controller may be programmed to permit a user to manually select a fan speed setting using the user interface. In response, the controller may initiate the timer, and may return to the Auto fan speed mode once the timer has expired.

The above summary is not intended to describe each disclosed embodiment or every implementation of the present invention. The Figures and Detailed Description that follow more particularly exemplify these embodiments.

BRIEF DESCRIPTION OF THE FIGURES

The invention may be more completely understood in consideration of the following detailed description of various embodiments of the invention in connection with the accompanying drawings, in which.

Figure 1:
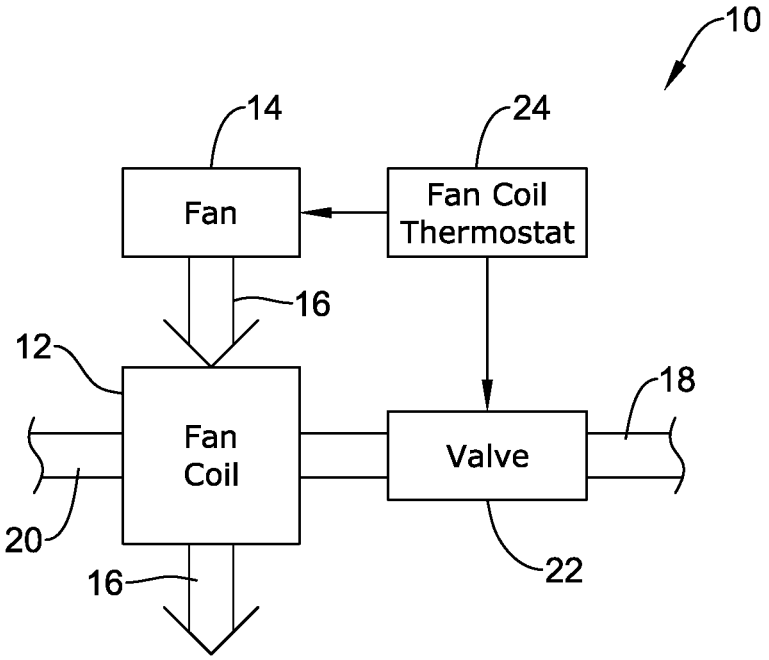
FIG. 1 is a schematic view of an illustrative but non-limiting fan coil system.

While the invention is amenable to various modifications and alternative forms, specifics thereof have been shown by way of example in the drawings and will be described in detail. It should be understood, however, that the intention is not to limit the invention to the particular illustrative embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials may be illustrated for the various elements, those skilled in the art will recognize that many of the examples provided have suitable alternatives that may be utilized.

FIG. 1 is a schematic view of an illustrative but non-limiting fan coil system 10. While the illustrative fan coil system 10 is schematically shown as a two-pipe fan coil system including a single supply line and a single return line, it will be appreciated that fan coil system 10 may instead be a four-pipe fan coil system having heated water supply and return lines as well as cooled water supply and return lines. In some cases, a four-pipe system may include a single fan coil while in other cases, a four-pipe system may include two fan coils, with one dedicated to heated and one dedicated to cooling. In a two-pipe fan coil system, the single supply line may, for example, provide heated water during the heating season and may provide cooled water during the cooling season.

The illustrative fan coil system 10 includes a fan coil 12. Fan coil 12 is a heat exchanger through which heated or cooled fluid flows. A fan 14 blows air across fan coil 12 as schematically shown by arrows 16. In some cases, fan 14 pulls ambient air from within the space and/or from outside the building. The ambient air is then heated or cooled by the fan coil 12 and provided into the space. In some cases, fan coil system 10 may be disposed within a housing (not shown) having a first vent or opening upstream of fan 14 and a second vent or opening downstream of fan coil 12. Fan 14 may pull air through the first vent or opening and then exhaust the heated or cooled air through the second vent or opening and into the space. The components may be arranged either horizontally or vertically within such a housing, as desired or perhaps as dictated by space considerations.

In order to accommodate fluid flow through fan coil 12, fan coil system 10 includes a supply line 18 and a return line 20. During the heating season, supply line 18 provides a source of heated fluid (such as water) from a suitable source such as a boiler or water heater, geothermal and/or the like. During the cooling season, supply line 18 provides a source of cooled fluid (such as water) from a suitable source such as an evaporative cooling tower or the like.

A valve 22 is disposed within supply line 18, upstream of fan coil 12, in order to control fluid flow through fan coil 12. In some cases, valve 22 may provide binary, i.e., on/off control while in other cases it is contemplated that valve 22 may be configured to provide a plurality of flow rates into fan coil 12.

Figure 2:
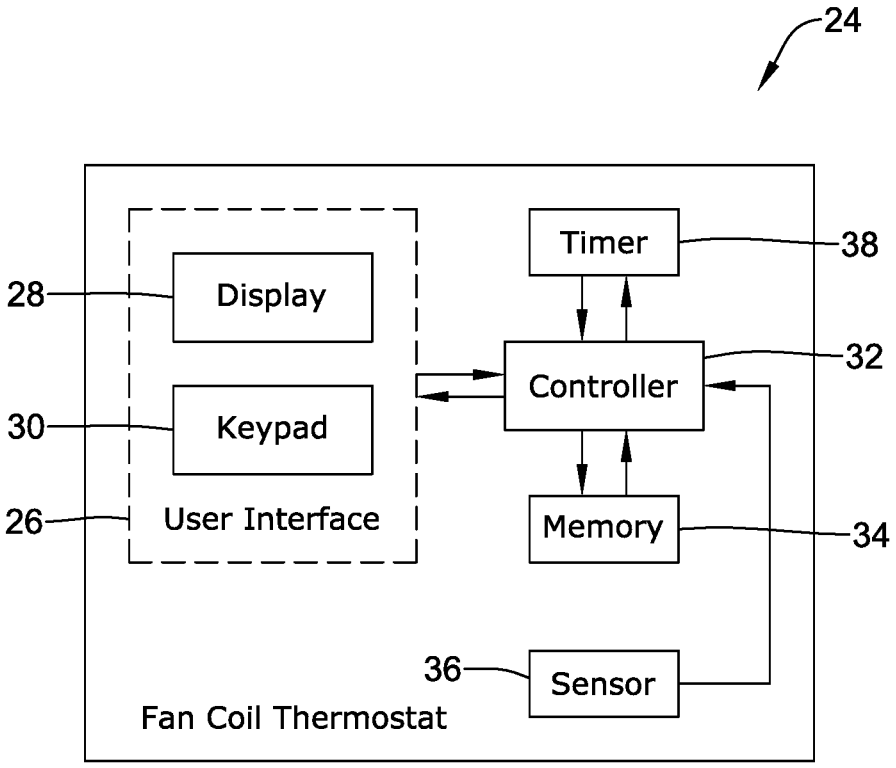
FIG. 2 is a schematic view of an illustrative but non-limiting fan coil thermostat as may be used in the fan coil system of FIG. 1.

Fan coil system 10 may include a fan coil thermostat 24 that controls operation of valve 22 and/or operation of fan 14 in order to achieve a desired temperature level within a space that is conditioned by fan coil system 10. Fan coil thermostat 24 is better described with respect to FIG. 2. FIG. 2 schematically shows various components of an illustrative fan coil thermostat 24. The illustrative fan coil thermostat 24 includes a user interface 26 that may include a display 28 and a keypad 30. Display 28 may be any suitable alphanumeric display medium that is capable of displaying visually discernible information. In some cases, display 28 may be a liquid crystal display (LCD), but this is not required. Keypad 30 may include one or more individual electromechanical buttons such as such as an on/off button, a temperature up button, a temperature down button, a fan speed up button, a fan speed down button, and the like. In some cases, it is contemplated that user interface 26 may be a touch screen LCD that encompasses the function of display 28 as well as keypad 30. That is, the buttons of keypad 30 may include, for example, electromechanical buttons, soft buttons, and/or touch regions on a touch screen display, as desired.

The illustrative fan coil thermostat 24 may include a controller 32. In some cases, controller 32 may implement a control algorithm that is adapted to at least partially control one or more components of fan coil system 10 and that may include an Auto fan speed mode setting. In some cases, the Auto fan speed mode may include an algorithm that determines fan speed based at least in part on if valve 22 (FIG. 1) is open or closed and/or how far valve 22 is open. In some instances, the Auto fan speed mode may dictate that fan 14 (FIG. 1) is off if valve 22 is closed. As valve 22 opens, the Auto fan speed mode may dictate that fan 14 is running at, for example, a low speed, a medium speed, a high speed or the like. In some cases, the Auto fan speed mode may determine a fan speed also based at least in part on a temperature differential between a current sensed temperature and a current temperature set point, and/or a current sensed humidity and a current humidity set point.

Controller 32 may be adapted to provide information to and/or receive information from user interface 26. Controller 32 may, for example, display a current temperature and/or a current temperature set point on display 28. Other examples of information that may be provided by controller 32 include a current fan speed, current fan mode, equipment status (on/off), current time, and the like. Examples of information that may be received from keypad 30 may include changes in a temperature set point, changes in fan speed and the like.

In some cases, the illustrative fan coil thermostat 24 may include a memory block 34. Memory block 34 may be used, for example, to store one or more unoccupied temperature set points, a current temperature set point, and/or programming that instructs controller 32 how to regulate valve 22 (FIG. 1) and/or fan 14 (FIG. 1) in order to obtain and maintain a particular temperature set point. Memory block 34 may store, for example, the aforementioned control algorithm.

In some instances, fan coil thermostat 24 may include a sensor 36 that provides controller 32 with information pertaining to current conditions within a space conditioned by fan coil system 10 (FIG. 1). Sensor 36 may be a temperature sensor, a humidity sensor and/or any other suitable sensor, as desired. In some cases, sensor 36 may be located internally to fan coil thermostat 24, although in some instances, sensor 36 may instead be located remotely from fan coil thermostat 24.

Fan coil thermostat 24 may include a timer 38. In some cases, timer 38 may be an electromechanical timer while in other instances timer 38 may be an electronic timer or may even be manifested in programming run by controller 32. In some instances, if a user operates one or more buttons of keypad 30, such as changing a temperature set point or perhaps changing the speed of fan 14 (FIG. 1), user interface 26 may provide a signal to controller 32 that provides controller 32 with a user-chosen temperature or perhaps a manually-selected fan speed setting. From this, controller 32 may also determine an indication of occupancy. i.e., that someone is in the space. In response, controller 32 may temporarily change the temperature set point from the unoccupied temperature setting to the user-chosen temperature setting, and/or change the fan speed setting to a manually-selected fan speed setting.

When the user first changes the fan speed setting, the controller 32 may temporarily change the fan speed from that specified by the default Auto fan speed mode to the manually-selected fan speed. In some cases, the manually-selected fan speed may be selected irrespective of a difference, if any, between an ambient temperature and a current temperature set point. For example, an individual may decide to set the fan speed to high even if the ambient temperature is equal or nearly equal to the current temperature set point. In some cases, the manually-selected fan speed may specify a fan speed that is higher and/or lower than what would otherwise be specified by the Auto fan speed mode. In some instances, the manually selected fan speed setting specifies a non-zero fan speed under conditions in which the Auto fan speed mode would specify a zero fan speed.

In addition to changing the fan speed in response to the signal from keypad 30 (FIG. 1), controller 32 may also initiate timer 38. Once the timer 38 expires after a predetermined time, controller 32 may change the fan speed of fan 14 (FIG. 1) to a fan speed that is specified by the Auto fan speed mode. The timer 38 may expire in any suitable time period. In some cases, the timer 38 may expire after about 1 hour. In some instances, the timer 38 may expire after about 2 hours, about 4 hours, about 6 hours, about 12 hours, or any other suitable time period, as desired. In some instances, and while waiting for the timer 38 to expire, controller 32 may be adapted to restart timer 38 if controller 32 receives an additional signal from the user interface 26 that indicates occupancy of the space.

Figure 3:
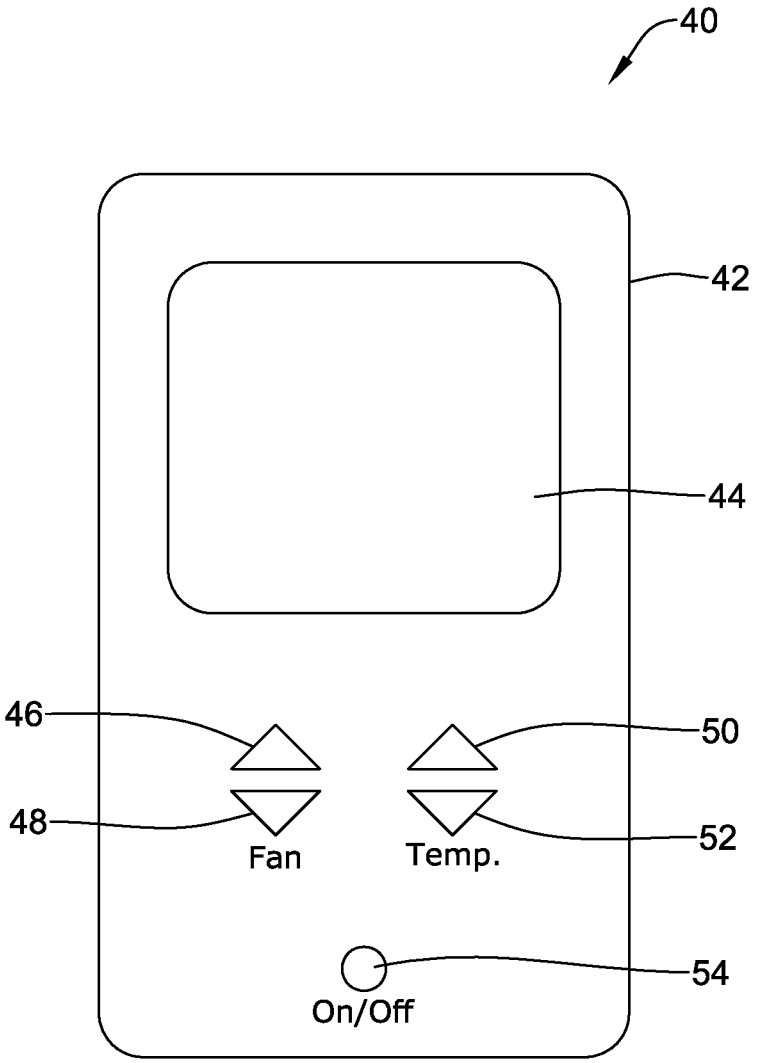
FIG. 3 is a front view of an illustrative embodiment of the fan coil thermostat of FIG. 2.

FIG. 3 is a front view of an illustrative fan coil thermostat 40. Fan coil thermostat 40 may be considered as an embodiment or perhaps as a particular example of fan coil thermostat 24 (FIG. 2). The illustrative fan coil thermostat 40 includes a housing 42 that may be formed of any suitable material such as molded plastic. The illustrative fan coil thermostat 40 also includes a display 44 that may be any suitable display such as an LCD display.

The illustrative fan coil thermostat 40 also includes several buttons that may be considered as examples of keypad 30 (FIG. 2). The buttons illustrated are not to be considered as limiting in any way, but are merely provided to show examples of buttons that may be included. As illustrated, fan coil thermostat 40 includes a fan speed up button 46 and a fan speed down button 48. In some cases, it is contemplated that fan coil thermostat 40 may include a single fan speed button (not shown) that can be pressed repeatedly to step through the available fan speed settings. In some instances, a slider button or even a rotary dial may be provided to select a fan speed setting.

As illustrated, fan coil thermostat 40 includes a temperature up button 50 and a temperature down button 52. A user may select and/or alter a temperature setting by pressing temperature up button 50 and/or temperature down button 52, as appropriate. A power button 54 may also be provided. It is contemplated that fan coil thermostat 40 may instead have a touch screen LCD that provides the functionality of display 44 as well as fan speed up button 46, fan speed down button 48, temperature up button 50, temperature down button 52, and power button 54. In some cases, the various buttons may be provided as touch regions on the touch screen display.

Figure 4:
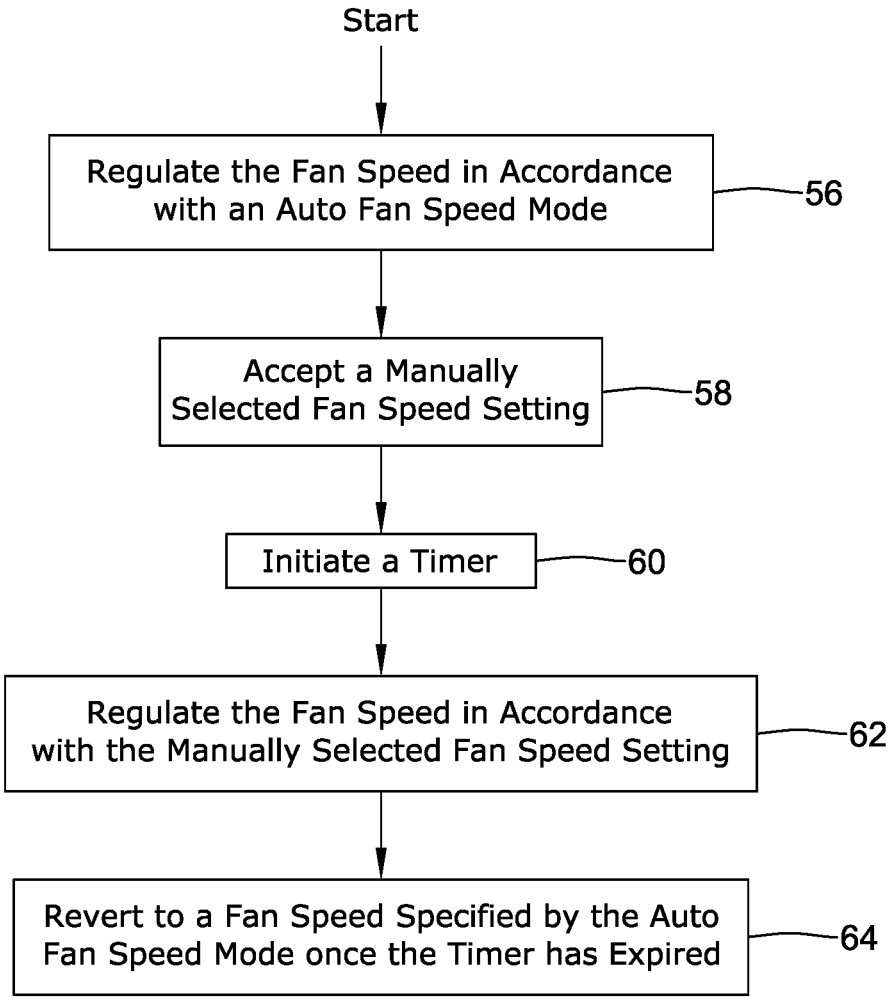
FIG. 4 is a flow diagram showing an illustrative method that may be carried out using the fan coil system of FIG. 1.

FIG. 4 is a flow diagram that shows an illustrative method that may be carried out by fan coil thermostat 24 (FIG. 2) and/or fan coil thermostat 40 (FIG. 3). At block 56, controller 32 (FIG. 2) regulates a fan speed of fan 14 (FIG. 1) in accordance with an Auto fan speed mode. At block 58, a manually selected fan speed setting is received from user interface 26 (FIG. 2), and then controller 32 initiates timer 38 (FIG. 2) as shown at block 60. The timer 38 may be adapted to expire after, for example, about 1 hour, about 2 hours, about 4 hours, about 6 hours, about 12 hours, or any other suitable time period. While waiting for the timer 38 to expire, controller 32 may instruct timer 38 to restart if, for example, another manually selected fan speed setting is entered via user interface 26. In some cases, controller 32 may instruct timer 38 to restart if, for example, any predetermined user input is received via the user interface 26 (e.g. the fan speed up button 46, the fan speed down button 48, the temperature up button 50, the temperature down button 52, and/or the power button 54 is pressed by the user).

Control passes to block 62, where controller 32 (FIG. 2) regulates the fan speed of fan 14 (FIG. 1) in accordance with the manually selected fan speed setting. At block 64, controller 32 reverts back to a fan speed specified by the Auto fan speed mode once timer 38 (FIG. 2) expires.

Figure 5:
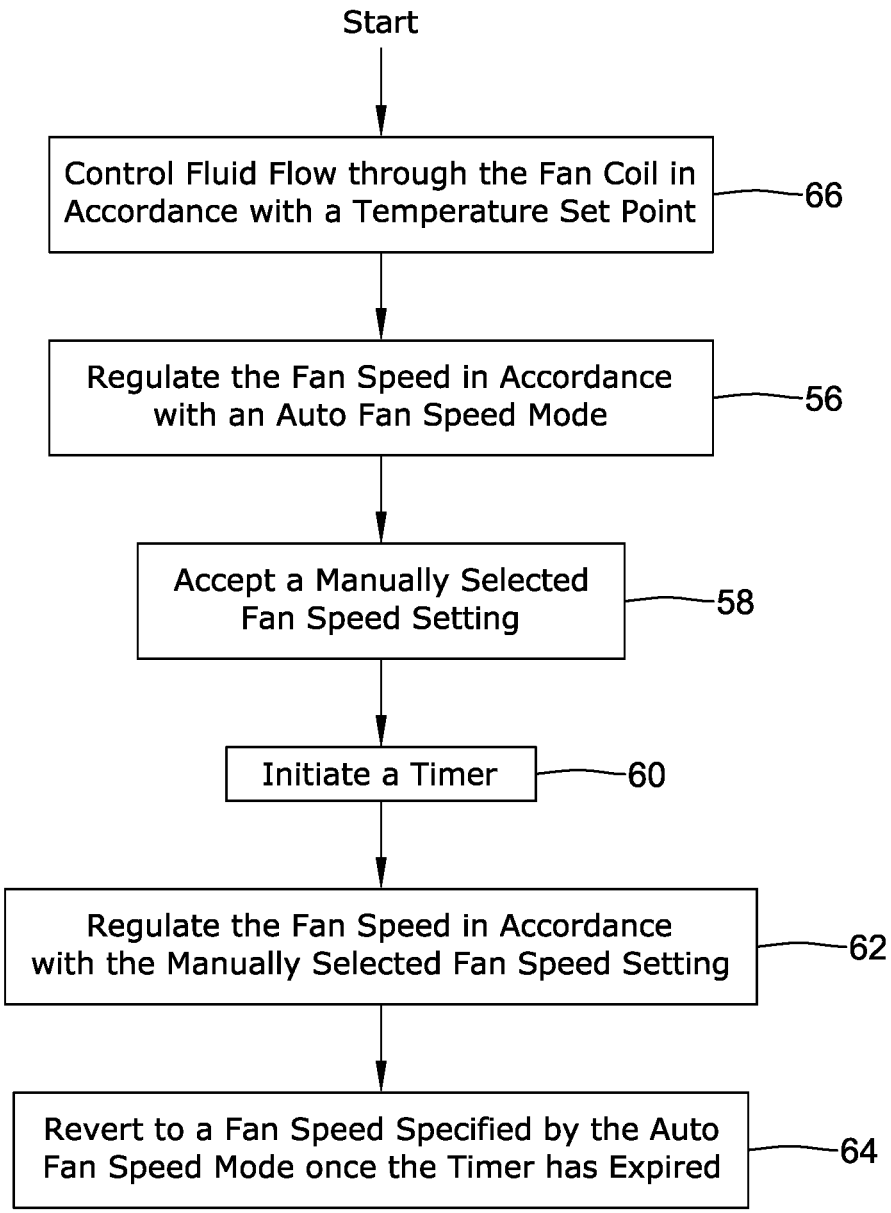
FIG. 5 is a flow diagram showing an illustrative method that may be carried out using the fan coil system of FIG. 1.

FIG. 5 is a flow diagram showing another illustrative method that may be carried out by fan coil thermostat 24 (FIG. 2) and/or fan coil thermostat 40 (FIG. 3). At block 66, controller 32 (FIG. 2) controls fluid flow through fan coil 12 (FIG. 1) by opening and/or closing valve 22 (FIG. 1). Control passes to block 56, where controller 32 (FIG. 2) regulates a fan speed of fan 14 (FIG. 1) in accordance with an Auto fan speed mode. At block 58, a manually selected fan speed setting is received from the user interface 26 (FIG. 2), and then controller 32 initiates timer 38 (FIG. 2) as shown at block 60. In some instances, the timer 38 may expire after about 1 hour, about 2 hours, about 4 hours, about 6 hours, about 12 hours, or any other suitable time period.

Control passes to block 62, where controller 32 (FIG. 2) regulates a fan speed of fan 14 (FIG. 1) in accordance with the manually selected fan speed setting. In some cases, this may mean running fan 14 even when no fluid is flowing through fan coil 12 (FIG. 1). In some instances, this may mean running fan 14 at a speed that is higher or lower than a speed that would otherwise be designated by the Auto fan speed mode with respect to a flow rate of fluid through fan coil 12. At block 64, controller 32 reverts back to a fan speed specified by the Auto fan speed mode once timer 38 (FIG. 2) expires.

While the present disclosure has been described with respect to illustrative fan coil systems that include one or more pipes carrying heated water for heating and/or cooled water for cooling, it should be noted that the inventive concepts described herein are not limited to such systems. Some systems may be hybrid-type systems, with an A/C compressor for cooling and heated water for heating. Some systems may be through-the-wall systems, having one or more of a compressor for air conditioning, an electric or gas heating element for heating, and a heat pump. Fan coil thermostat 40 may, for example, be used with these systems as well as the systems described herein.

The present disclosure should not be considered limited to the particular examples described above, but rather should be understood to cover all aspects of the invention as fairly set out in the attached claims. Various modifications, equivalent processes, as well as numerous structures to which the present invention can be applicable will be readily apparent to those of skill in the art to which the present invention is directed upon review of the instant specification.

We claim:

1. A fan coil thermostat for use with a fan coil system that has a fan, the fan coil thermostat comprising:

a controller implementing a control algorithm that is configured to at least partially control one or more components of the fan coil system including the fan, the control algorithm including an Auto fan speed mode for automatically selecting a fan speed for the fan from three or more different fan speeds, wherein the three or more different fan speeds include a zero fan speed and two or more non-zero fan speeds;

a user interface including a fan speed up button, a fan speed down button, a temperature up button and a temperature down button;

a timer controlled by the controller;

wherein, while in the Auto fan speed mode, the controller is programmed to permit a user to manually select a fan speed that is one of the three or more different fan speeds by engaging only the fan speed up button and/or the fan speed down button, and in response to the user manually selecting the fan speed via the fan speed up button and/or the fan speed down button, the controller initiating the timer, and once the timer expires, the controller returning to the Auto fan speed mode;

wherein the timer expires after a time period; and wherein while waiting for the timer to expire, the controller restarts the timer if the user manually selects the fan speed up button, the fan speed down button, the temperature up button or the temperature down button.

2. The fan coil thermostat of claim 1, wherein the controller, when operating in accordance with the Auto fan speed mode, changes the fan speed based, at least in part, on a difference between an ambient temperature and a current temperature set point of the fan coil thermostat.

* * * * *